US005661099A

United States Patent [19]

Mitchell, Jr.

[11] Patent Number: 5,661,099

[45] Date of Patent: Aug. 26, 1997

[54] SELF-WOUND DIRECT THERMAL PRINTED LABELS

[75] Inventor: Chauncey T. Mitchell, Jr., Lakeland, Tenn.

[73] Assignee: Media Solutions, Inc., Lakeland, Tenn.

[21] Appl. No.: 513,673

[22] Filed: Aug. 4, 1995

Related U.S. Application Data

[63] Continuation of Ser. No. 202,838, Feb. 28, 1994, abandoned.

[51] Int. Cl.[6] ..... B41M 5/40

[52] U.S. Cl. ..... 503/201; 156/252; 283/105; 427/150; 427/152; 503/226

[58] Field of Search ..... 156/252; 283/101, 283/105; 427/150, 152; 503/200, 201, 205, 226

[56] References Cited

U.S. PATENT DOCUMENTS

| | | | |
|---|---|---|---|
| 4,253,899 | 3/1981 | Takemoto et al. | 156/277 |
| 4,415,615 | 11/1983 | Esmay et al. | 428/40 |
| 4,525,566 | 6/1985 | Homan et al. | 528/17 |
| 4,577,204 | 3/1986 | Shibata et al. | 503/200 |
| 4,587,156 | 5/1986 | Wu | 428/207 |
| 4,587,167 | 5/1986 | Maietti et al. | 428/352 |
| 4,708,907 | 11/1987 | Flutti et al. | 428/352 |
| 4,711,874 | 12/1987 | Yuyama et al. | 503/206 |
| 4,720,479 | 1/1988 | Craig et al. | 503/200 |
| 4,851,383 | 7/1989 | Fickenscher et al. | 503/200 |
| 4,861,651 | 8/1989 | Goldenhersh | 428/255 |
| 4,886,774 | 12/1989 | Doi | 503/226 |
| 5,168,002 | 12/1992 | Maietti | 428/352 |
| 5,242,650 | 9/1993 | Rackovan et al. | 264/509 |
| 5,272,127 | 12/1993 | Mandoh et al. | 503/227 |
| 5,292,713 | 3/1994 | Stenzel et al. | 503/226 |
| 5,354,588 | 10/1994 | Mitchell et al. | 428/40 |

FOREIGN PATENT DOCUMENTS

| | | | |
|---|---|---|---|
| 59-107264 | 7/1984 | Japan | 503/227 |
| 60-54842 | 3/1985 | Japan | 503/227 |
| 2165988 | 6/1990 | Japan | 503/226 |

OTHER PUBLICATIONS

"Rising Thermals", *Packaging Week* Magazine, PW Info No. 124, Nov. 29, 1989, p. 27.

*Primary Examiner*—B. Hamilton Hess
*Attorney, Agent, or Firm*—Eugene Stephens & Associates

[57] ABSTRACT

A self-wound label stock includes a thermal paper substrate. One face of the substrate is coated with a primer layer having ultraviolet light blockers and a release layer having a smooth surface finish. Another face of the substrate is coated with an adhesive layer. Non-thermal printing is applied between the substrate and the primer layer. Thermal printing is applied to the substrate through the primer and release layers. A separator divides the label stock into individual labels.

9 Claims, 2 Drawing Sheets

SELF-WOUND DIRECT THERMAL PRINTED LABELS

RELATED APPLICATIONS

This application is a continuation of parent application Ser. No. 08/202,838, filed 28 Feb. 1994, entitled SELF-WOUND DIRECT THERMAL PRINTED LABELS, and abandoned upon the filling of this continuation application.

FIELD OF INVENTION

The invention relates to the field of label making, including tickets, tags, receipts, and other printed media. Label stock is unwound from a roll prior to printing and is thereafter dispensed as individual labels.

BACKGROUND

Ordinarily, wound label stock includes a printable substrate such as paper or plastic having a first face exposed for printing and a second face at least partially covered by an adhesive, such as a pressure-sensitive adhesive. A liner having a release surface separates the adhesive from the substrate while the label stock is wound into a roll. After printing and die cutting, individual labels are removed from the liner for use. The liner is discarded.

Disposal of the liners can be a significant problem because most liners do not readily degrade. Special treatments needed to dispose of the liners add cost to the labels. In addition, the liners increase thickness of the label stock, thereby reducing the number of winds in a given diameter roll; and this reduces the number of labels that can be printed from a given diameter roll.

Writeable adhesive tapes are also known which include a substrate coated on one side with an adhesive and on an opposite side with a special release coating that can receive ink or other marking substances. However the special release coatings can add cost to the tapes, and the markings can be less permanent than desired.

SUMMARY OF INVENTION

My invention involves improved wound label stock that includes an adhesive backing but does not require removable liners or special release coatings that accept ink. Instead, conventional paper or plastic substrates are replaced by a thermally receptive imaging material, and a release coating that is chemically inert to demand thermal printing is applied to the thermal imaging material to protect the imaging material from the adhesive as well as environmental hazards during use.

One example of my invention includes a thermal paper substrate in the form of a continuous length web having front and back faces. A layer of adhesive is applied to the back face of the thermal paper web, and a layer of release coating is applied to the front face of the web. After coating, the web is self wound into a plurality of coils so that the adhesive layer of one coil is contiguous with the release layer of another coil.

Preferably, a layer of primer is also applied to the thermal paper web between the web and the release layer. The primer layer incorporates ultraviolet blockers that absorb wavelengths of ultraviolet radiation that tend to fade images produced in thermal paper. The release layer is preferably a silicone base material having low adhesion to the adhesive. Together, the primer and release layers also protect the thermal paper from physical abrasion, water and humidity, and damage from certain kinds of chemicals.

The release layer has a smoother finish than the thermal paper, and this enhances transfers of heat and reduces friction between a thermal print head of a thermal printing machine and the thermal paper. The enhanced transfers of heat result in improved image quality. The reduced friction extends service life of the print head and reduces power requirements for moving the print head with respect to the paper.

Non-thermal printing (e.g., flexographic, letter press, offset press, silk screen, or ink jet) can also be applied to the thermal paper prior to applying the primer and release layers. Preferably, the non-thermal printing is applied in a repeating pattern that can be registered with subsequent demand thermal printing to produce a series of labels that contain unique information. For example, the repeating pattern could be a form that is filled out by demand thermal printing. Alternatively, a more random pattern could be used to add identifying logos, warnings, or security information to labels that are demand thermal printed at varying lengths.

DRAWINGS

DETAILED DESCRIPTION

Figure 1:
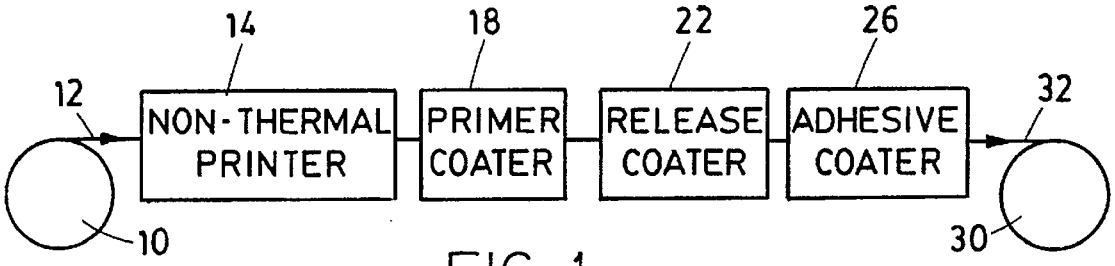
FIG. 1 is a diagram of my system for making new self-wound label stock.

A system for making my new self-wound label stock is shown in FIG. 1, including a supply roll 10 of thermal paper 12 having a thermosensitive layer (not shown) for producing an image on the paper in response to the controlled application of heat and pressure. A wide variety of grades of thermal paper, as well as other base materials, can be used in my invention. For example, wide-ranging types of thermal paper appropriate for practicing my invention are available from Kanzaki Specialty Papers of Ware, Massachusetts.

Figure 2:
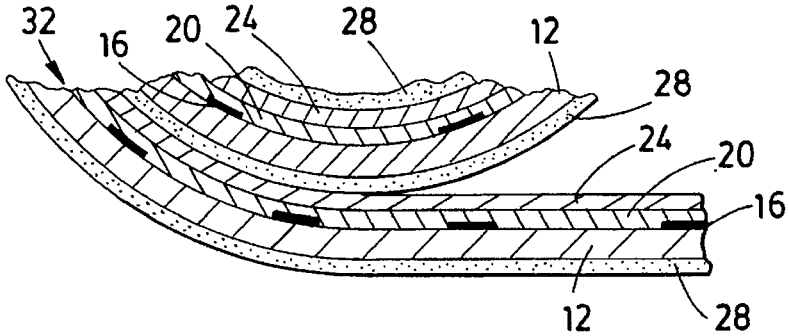
FIG. 2 is a greatly enlarged cross-sectional view of the new self-wound label stock.
Figure 4:
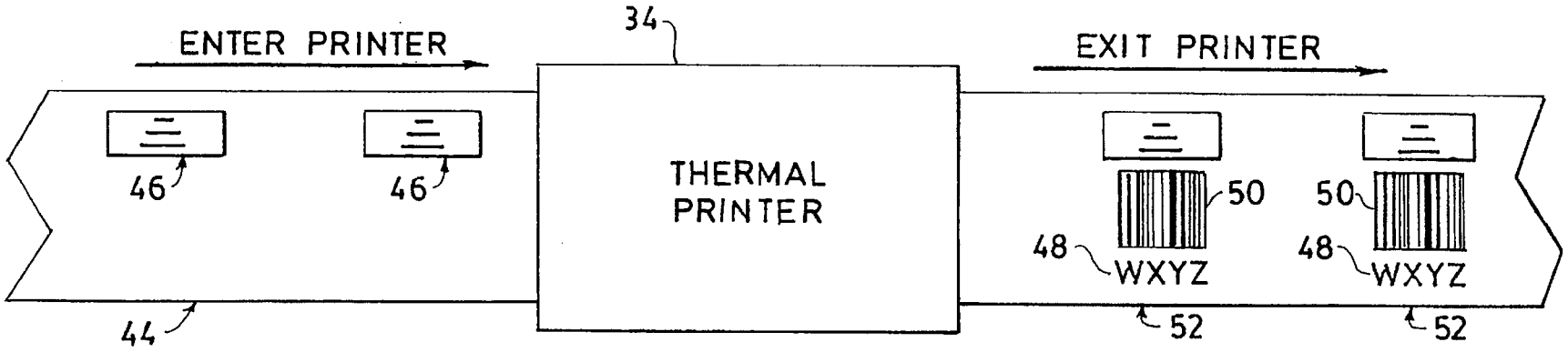
FIG. 4 illustrates the application of demand thermal printing to label stock that is non-thermally printed with a repeating fixed length pattern.
Figure 5:
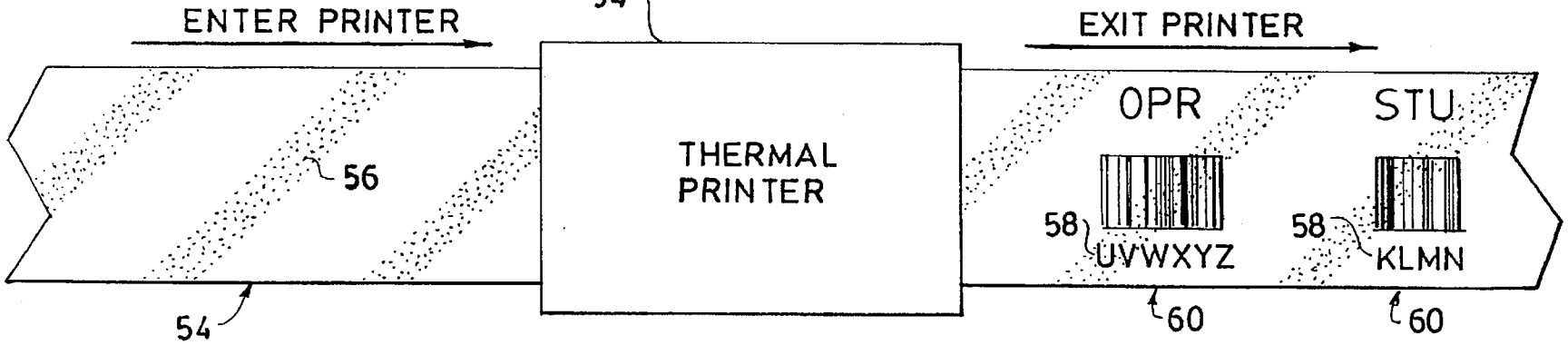
FIG. 5 illustrates the application of demand thermal printing to label stock that is non-thermally printed in a pattern having no fixed length.

The thermal paper 12, which takes the form of a continuous length web, is first processed by a non-thermal printer 14. A wide variety of non-thermal printers and printing techniques (e.g., flexographic, letter press, offset press, silk screen, or ink jet) can be used to add patterns and colors to the thermal paper. FIG. 2 shows regular patches of ink 16 applied in one of these manners to a top surface (i.e., front face) of the thermal paper 12. More explicit examples of non-thermal printing are shown in FIGS. 4 and 5, which will be discussed in turn.

A primer coater 18 applies a primer layer 20 over both the thermal paper 12 and the patches of ink 16. The primer layer 20 is preferably an ultraviolet curable mixture containing ultraviolet blockers similar to a mixture disclosed in U.S. Pat. No. 4,886,774 to Alfred Doi; and this patent is hereby incorporated by reference. The range of ultraviolet wavelengths that are blocked by the primer layer 20 corresponds to wavelengths that have "photodegrative effects" on the thermal paper (i.e., fade images produced by reactive chemicals in the thermosensitive layer) but is different from the range of ultraviolet wavelengths that are used to cure the primer layer 20.

After the primer layer 20 has sufficiently cured, a release coater 22 applies a release layer 24 over the primer layer 20. The release layer 24 is preferably a silicone-based material that exhibits low adhesion to certain adhesives but bonds tightly to the primer layer 20. A similar range of ultraviolet wavelengths is also used to cure the release layer 24.

The primer layer 20 and the release layer 24 cooperate to protect the thermal paper 12 from a variety of environmental hazards without interfering with the necessary chemical interactions within the thermosensitive layer of the thermal paper 12. For example, the two layers 20 and 24 protect the thermal paper 12, as well as the preprinted ink 16, from physical abrasion, water damage, and certain kinds of common chemicals that darken the thermal paper or otherwise fade thermal images produced in the paper. The release layer 24 also has a very smooth surface that reduces friction with other surfaces and associated heat which can induce unwanted images in the paper. The smooth surface of the release layer 24 is also unreceptive to printing inks and other marking compounds to further avoid unwanted markings on the thermal paper 12.

An adhesive coater 26 applies a layer of adhesive 28 to a bottom side (i.e., back face) of the thermal paper 12. The thermal paper 12 is chilled after applying the adhesive layer 26 as a hot melt to prevent thermal damage to the paper. For many applications of my invention, the adhesive layer 28 consists of a pressure-sensitive adhesive. However, special applications may require the adhesive to be applied in a special pattern or to exhibit other properties such as co-adhesion, repositionability, removability, or resistance to cold.

The treated thermal paper 12 is rewound onto a dispensing roll 30 as self-wound label stock 32. FIG. 2 shows how the adhesive layer 28 of one coil of the label stock 32 is contiguous with the release layer 24 of another coil. Thus, the top surface of the thermal paper 12 and the patches of ink 16 are protected from contact with the adhesive layer 28 by the release layer 24.

Figure 3:
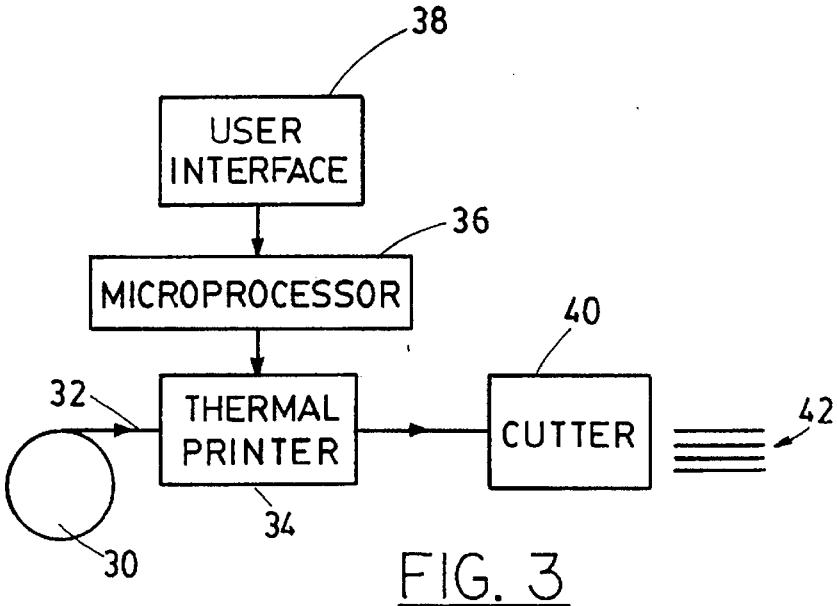
FIG. 3 is a diagram of a printing system for converting the new self-wound label stock into individual demand printed labels.

FIG. 3 shows the dispensing roll 30 arranged for supplying a direct thermal printer 34 with the new label stock 32. A microprocessor 36 having a user interface 38 controls operation of the thermal printer 34 to produce unique images in the thermal paper 12. The smooth surface finish of the release layer 24 reduces friction with a print head (not shown) of the thermal printer 34. The reduced friction is expected to extend the service life of thermal print heads and to reduce power requirements for operating thermal printers.

A separator, which can take the form of a cutter 40, divides the label stock 32 into individual labels 42 containing unique information. Alternatively, the label stock 32 could be perforated or aligned with a tear bar for manually separating the label stock into the individual labels 42. For example, the label stock could be perforated just prior to applying the primer layer 20 so that the layers of primer 20 and release 24 at least partially protect the perforations from being impregnated with the adhesive 28. The cutter 40 could also be used to chamfer corners of the individual labels 42.

Two examples of direct thermally printed labels are shown in FIGS. 4 and 5. In FIG. 4, a label stock 44 in which non-thermal printing has been applied in a repeating pattern defining a series of equal length forms 46 is supplied to the thermal printer 34. The forms 46 are registered with the thermal printer 34, and unique text 48 and bar code information 50 are thermally printed to complete a series of fixed length labels 52.

In FIG. 5, a label stock 54 having a non-thermally printed background 56 is fed into the thermal printer 34. Thermal printing is applied as unique groupings of text 58 that define individually variable length labels 60. The non-thermal printing of both the fixed and variable length labels 52 and 60 can be a different color from the thermal printing to convey information more effectively.

Although my system for making my new self-wound label stock 32 has been illustrated as a single-pass in-line system, the label stock 32 could also be made in a multi-pass system in which the label stock is unwound and rewound between processing steps. After completion of the processing steps, the label stock 32 could also be rewound "coreless" to further reduce waste material.

Both the primer layer 20 and the release layer 24 could be cured in a variety of additional ways including evaporation, electron beam, and catalyzation. In place of the primer layer 20, the release layer 24 could be modified to incorporate the ultraviolet light blockers and be applied directly to the thermal paper 12 or similar substrate. It might also be possible to apply the release layer 24 as a part of the thermosensitive layer of the thermal paper 12.

The adhesive layer 28 could also be applied indirectly to the back face of the thermal paper 12, first, by depositing the adhesive layer 28 on the release layer 24 and, second, by transferring the adhesive layer 28 to the back face during the rewinding operation. Other types of adhesive could also be used including water based, solvent based, and laminated adhesives. The non-thermal printing could also be applied to the back face of the thermal paper 12 or to the adhesive layer 28.

The new self-wound labels are expected to have wide-ranging applicability. For example, the new self-wound labels can be used in a variety of portable labeling applications such as shelf, product, and parcel delivery labels. No liner must be discarded and the new labels resist abrasion. The new labels also resist staining and are especially suitable for marking meat products.

Resistance to weather and dirt also make these new self-wound labels suitable for airline luggage tags. A patterned adhesive would be applied in strips to the back of a reinforced substrate so that opposite ends of the label could be looped around a luggage handle and stuck together.

The new self-wound labels could also be used with automatic label applicators in which the labels are "blown on" or otherwise affixed to products advanced by conveyers. The liner waste product is avoided, and more labels can be applied from given size rolls.

I claim:

1. A method of making self-adhesive labels comprising the steps of:

preparing a substrate coated with thermally receptive imaging material as a continuous length web;

forming perfroations in said substrate at regular intervals along its length;

applying a release layer over said thermally receptive imaging material on a first face of the substrate;

applying an adhesive layer on a second face of the substrate;

said release layer being applied after forming said perforations and before applying said adhesive layer to protect said perforations from being impregnated with adhesive; and winding said substrate into a plurality of coils so that said adhesive layer on one coil is contiguous with said release layer on an adjacent coil.

2. The method of claim 1 including the further step of non-thermally printing on said first face of the substrate in a color that is different from a color added by said step of thermally printing.

3. The method of claim 2 in which said step of non-thermally printing involves printing a repeating pattern that defines a succession of fixed length labels.

4. The method of claim 2 in which said step of non-thermally printing also involves printing on one of (a) said second face of the substrate and (b) said adhesive layer.

5. The method of claim 1 including the further step of applying a primer layer containing ultraviolet light blockers between said substrate and said release layer.

6. The method of claim 5 in which said step of forming perforations is performed before said step of applying a primer layer, and said step of applying said primer layer is applied before said step of applying said release layer.

7. The method of claim 1 in which said step of applying the adhesive layer includes chilling the substrate for applying the adhesive as a hot melt without inducing undesirable thermal imaging in said first face of the substrate.

8. The method of claim 1 in which said step of applying the adhesive layer includes depositing the adhesive layer on said release layer and transferring said adhesive layer to said second face of the substrate during said step of winding the substrate.

9. The method of claim 1 including the further steps of:

progressively unwinding said substrate into a thermal printer;

thermally printing on said first face of the substrate through said release layer in distinct patterns the distinguish successive labels; and dispensing the successive labels for individual use without producing waste material in the form of a separate liner protecting the adhesive layer prior to use.

* * * * *